United States Patent [19]

Ragg et al.

[11] 4,405,407

[45] Sep. 20, 1983

[54] FIBROUS MATERIALS

[75] Inventors: Pudens L. Ragg, Hartburn; Graham E. Martin, Nunthorpe; Roy Smeeton, Sedgefield, all of England

[73] Assignee: Imperial Chemical Industries PLC, London, England

[21] Appl. No.: 250,154

[22] Filed: Apr. 2, 1981

[30] Foreign Application Priority Data

Apr. 16, 1980 [GB] United Kingdom ..... 8012488

[51] Int. Cl.[3] ..... D21H 5/12

[52] U.S. Cl. ..... 162/146; 162/157.2; 162/206

[58] Field of Search ..... 162/146, 157 R, 206, 162/157.2

[56] References Cited

U.S. PATENT DOCUMENTS

| | | | |
|---|---|---|---|
| 3,101,294 | 8/1963 | Fridrichsen | 162/146 |
| 4,138,445 | 2/1979 | Nogi et al. | 264/176 F |
| 4,172,057 | 10/1979 | Henbest | 162/146 |
| 4,202,959 | 5/1980 | Henbest et al. | 162/146 |
| 4,268,351 | 5/1981 | Henbest et al. | 162/146 |

FOREIGN PATENT DOCUMENTS

| | | | |
|---|---|---|---|
| 2810299 | 9/1978 | Fed. Rep. of Germany | 162/146 |
| 51-19804 | 2/1976 | Japan | 162/146 |
| 572962 | 10/1945 | United Kingdom | 162/146 |
| 1573115 | 8/1980 | United Kingdom . | |

*Primary Examiner*—Peter Chin

*Attorney, Agent, or Firm*—Cushman, Darby & Cushman

[57] ABSTRACT

Fibrous materials in the form of shaped articles such as paper are made from heat-cured amino-formaldehyde resin fibres having a degree of cure of at least 93%, optionally in admixture with other fibres. The amino-formaldehyde resin fibres are welded to one another and/or to the other fibres. The welding is brought about by subjecting the shaped article to pressure and to heat in the presence of water.

7 Claims, No Drawings

FIBROUS MATERIALS

This invention relates to fibrous materials and in particular to shaped articles containing amino-formaldehyde resin fibres.

Amino-formaldehyde resin fibres are useful as the fibrous constituents in shaped articles, particularly sheet like articles such as paper where they are generally used in admixture with cellulosic fibres.

Papers made wholly from amino-formaldehyde resin fibres tend to have little or no strength because generally the fibres exhibit little or no self adhesion. When blended with cellulosic fibres, the latter donate strength to the paper but in many cases it would be desirable to improve the strength still further.

One way of improving the strength is to employ partially cured (degree of cure 50–90%) amino-formaldehyde resin fibres. Thus in European Patent Specification No. 14026, paper is made from partially cured amino-formaldehyde resin fibres made by employing only mild curing conditions, i.e. weak curing catalysts, low curing temperatures and/or short curing times. Partially cured amino-formaldehyde resin fibres can also be made as described in U.S. Pat. No. 4,202,959 by performing the reaction of the amino compound with the formaldehyde in the presence of sources of certain inorganic oxyacid radicals, e.g. sulphite radicals. Partially cured amino-formaldehyde resin fibres can also be made as described in U.S. Pat. No. 4,172,057 by conducting the reaction of the amino compound with the formaldehyde in the presence of certain carbohydrates.

The degree of cure of amino-formaldehyde resin fibres is measured by digesting an accurately weighed sample (about 5 g) of the dry fibre in 200 ml of water for 2 hours at 50° C. The undissolved fibre is recovered by filtration, dried at 100° C. in air for 2 hours, and then reweighed. The degree of cure is the ratio between the weight of the recovered fibre and the original weight of fibre, and is expressed herein as a percentage.

While amino-formaldehyde resin fibres that have only been partially cured may exhibit some self adhesion and so be used as the sole fibrous component of paper, they suffer from the disadvantages that some of the fibre may be lost during the conventional wet-laid paper production process because of the partial water solubility of the partially cured resin and also that free formaldehyde may be evolved during the paper making process thus constituting a health hazard.

It has now found that, under certain conditions, articles, e.g. paper, of improved strength, containing amino-formaldehyde resin fibres having a higher degree of cure can be made.

In the present invention, the processing conditions are such as to cause welding of the amino-formaldehyde resin fibres to each other and/or to other fibrous materials present at at least some of the points where the fibres contact one another. Such welding is referred to herein as inter-fibre bonding. Inter-fibre bonding can be observed using a microscope: thus if a sample of the article, e.g. paper, is observed using a magnification of X100 or greater, welds between at least some of the fibres can be seen. It will be appreciated that it is not necessary, in order to obtain useful improvements in strength, that every fibre should be welded to another fibre. However the degree of inter-fibre bonding should preferably be such that less than 50% by weight of the amino-formaldehyde resin fibres can be removed from the sample as individual fibres without any fibres adhering thereto when the sample is probed with a fine probe.

It has been proposed in United Kingdom Patent Specification No. 1,574,344 to make paper from a mixture of cellulose pulp and urea-formaldehyde (UF) resin fragments, particularly fragments of a UF foam, that have been partially cured by acidification at a temperature below 60° C. After forming the cellulose pulp/UF fragments mixture into sheet form, the latter is heated at above 80° C. to effect further curing of the UF resin. It is said that this process gives a continuous chemically bonded network in the paper.

Inter-fibre bonded articles made in accordance with the present invention differ from the products of BP No. 1,574,344 in various respects.

In the process of BP No. 1,574,344 the use of a cellulose pulp is essential and it is postulated that a chemical bond is formed between the UF fragments and the cellulose: it is indicated that papers made from non-cellulosic fibres and the fragments have insignificant strength. In contrast inter-fibre bonded articles of significant strength can be made in accordance with the present invention using amino-formaldehyde resin fibres alone or in admixture with non-cellulosic fibrous materials.

Furthermore it is indicated in BP No. 1,574,344 that the incorporation of the UF fragments gives rise to little or no increase in bulk of the paper: the bulk is said to increase by less than 0.1 $cm^3g^{-1}$ for each 10% by weight of UF fragments incorporated. In contrast thereto inter-fibre bonded articles containing amino-formaldehyde resin fibres and cellulose fibres exhibit a significant increase in bulk: the bulk increases by at least about 0.15 $cm^3g^{-1}$ for each 10% by weight of amino-formaldehyde resin fibres incorporated. The enhancement in bulk generally becomes more pronounced as the degree of beating of the cellulose pulp increases.

In contrast to the process of BP No. 1,574,344, in the present invention the amino-formaldehyde resin is in the form of fibres that have been hot cured to a high degree before the shaped article is formed therefrom.

Accordingly the present invention provides a process for making a shaped article comprising (i) forming a solution of an amino-formaldehyde resin and a curing catalyst therefor into fibres, (ii) curing said fibres by heating them at above 100° C. until the degree of cure is above 93%, (iii) forming an aqueous pulp by dispersing fibrous material in water, said fibrous material containing at least 5% by weight of said cured amino-formaldehyde resin fibres, (iv) forming a shaped article from said pulp, and (v) promoting inter-fibre bonding by heating said shaped article at a sufficiently high temperature above 80° C., for sufficient time, and in the presence of a sufficient amount of water above 10% by weight of the total weight of fibrous material present, with the application of pressure, before or during said heating, at least sufficient to cause contact between adjacent fibres, so as to cause at least some of the amino-formaldehyde resin fibres to weld to one another and/or to other fibrous material present at at least some of the points where the fibres touch one another.

While applicants do not wish to be bound by the following theory, it is thought that, in the process of the present invention, at least some of the highly cured amino-formaldehyde resin fibres undergo slight hydrolysis at their surfaces thus rendering them somewhat tacky under the prevailing conditions of temperature and moisture. Where such a tackified fibre contacts, e.g. at a point where fibres cross, another fibre (whether or not the other fibre is another tackified amino-formaldehyde resin fibre) fusion or welding at the intersection occurs. As no tackiness of the fibres is however detected in the final product it is thought that dehydration and recondensation of the tackified fibre surfaces occurs as the heating and drying is continued.

The existence of inter-fibre bonding in water-sensitive articles, e.g. paper containing some cellulosic fibres, can also be assessed by measuring the wet strength of the sample: if inter-fibre bonding has occurred the wet strength of the sample will be increased. It is preferred that the wet strength is increased by at least 25% compared with a similar sample in which no inter-fibre bonding exists. The wet strength of a sample in the form of paper may be measured by Tappi Standard Method T456.

It will be appreciated that where a binder is present in the article the wet strength measurement and probing may not be indicative of the presence of inter-fibre bonding but such inter-fibre bonding can be detected by microscopy.

Where the article contains little or no cellulose fibres, there may be little difference between the wet and dry strengths of the article.

In the process of the invention in order to generate inter-fibre bonding, the shaped article is subjected to the action of water at an elevated temperature.

The fibrous material may be formed into the desired shape and then wetted and subjected to the elevated temperature or the shaped article may be formed from an aqueous slurry of the fibrous materials and subjected to the elevated temperature as part of the drying process used to remove the water. Thus in the production of paper-like sheet articles, the paper may be made by a conventional wet-laid process and then subjected to inter-fibre bonding conditions in the drying stages of paper manufacture.

The conditions required to generate inter-fibre bonding vary with the degree of cure of the amino-formaldehyde resin fibres. Thus as the degree of cure increases above 93% by weight, the minimum amount of water in the shaped article required to get inter-fibre bonding increases. As the temperature increases the drying time required decreases.

The temperature should be at least 80° C. and is preferably in the range 90° to 180° C. The application of pressure before, or preferably during, the heating step promotes inter-fibre bonding. The pressure may vary from just sufficient to ensure good contact between adjacent fibres, typically 0.1 kg $cm^{-2}$, to 50 kg $cm^{-2}$ or more depending upon the water content and the drying conditions. As the applied pressure increases, less water is required. While the application of pressure is not always necessary, its application enables inter-fibre bonding to be obtained in some borderline cases where, in the absence of applied pressure, no inter-fibre bonding is achieved.

The time required may vary from about 30 seconds to 10 minutes or more: it will be appreciated that longer times than the minimum required to achieve inter-fibre bonding may be employed.

The minimum water content required to achieve inter-fibre bonding varies from about 10% by weight of the fibrous material (at low degrees of cure, high temperature and pressure) to over 300% (at low pressures and temperature and high degree of cure). Again it will be appreciated that more water than the minimum required to achieve inter-fibre bonding may be employed. Preferably at least 200% by weight of water is used, based on the dry weight of the fibrous material.

Simple experimentation will enable conditions where inter-fibre bonding results to be determined.

A pressing step if used, may be part of the shaping process: thus the fibrous material may be moulded into the desired shape at the same time as it is subject to the conditions of moisture, and elevated temperature; or the fibrous material may be moulded/pressed into the desired shape at ambient temperature and then subjected to the conditions of moisture and elevated temperature.

The amino-formaldehyde resin used to make the amino-formaldehyde resin fibres is a condensate of an amino compound, preferably a polyamine such as urea or melamine, with formaldehyde. The amino compound is preferably urea, alone or in admixture with up to 5% by weight of melamine. The molar ratio of formaldehyde to amino groups is preferably between 0.6:1 and 1.5:1 particularly between 0.7:1 and 1.3:1.

The amino-formaldehyde resin fibres may be made by any suitable fibre forming technique such as wet or dry spinning and are preferably formed by a centrifugal spinning process, for example as described in U.S. Pat. No. 4,178,336, which gives, as is preferred, substantially straight and unbranched fibres.

The amino-formaldehyde resin fibres preferably have an average length, weighted by length, of between 1 and 10 mm, particularly between 2 and 6 mm. Preferably substantially all the amino-formaldehyde resin fibres have a length within the range 1 to 10 mm.

The amino-formaldehyde resin fibres preferably have an average diameter between 1 and 20 μm, particularly between 2 and 15 μm, and most particularly between 3 and 10 μm. Preferably substantially all the amino-formaldehyde resin fibres have a diameter between 1 and 30 μm. The amino-formaldehyde resin fibres preferably have an average strength of at least 50 $MNm^{-2}$ (which corresponds approximately to 33 $Nmg^{-1}$), particularly at least 100 $MNm^{-2}$ ($\equiv$67 $Nmg^{-1}$).

The amino-formaldehyde fibres should have a degree of cure of at least 93%, preferably 94 to 99% by weight. In the process of the present invention, these degrees of cure are achieved by incorporating a suitable curing catalyst, e.g. ammonium sulphate, ammonium chloride, formic acid, dihydrogen ammonium phosphate, or phosphoric, sulphuric, sulphamic, or hydrochloric acids into the resin prior to spinning into fibres and then heating the fibres after spinning at above 100° C., particularly above 120° C. for e.g. up to 3 hours: in general the higher the curing temperature, the shorter the time required. Thus while 3 hours at 120° C. may give a degree of cure of about 94% by weight, only 5 minutes may be required at 180° C. to give a degree of cure of about 97%.

The shaped article may be made from the amino-formaldehyde resin fibres as the sole fibrous constituent or may be made from the amino-formaldehyde resin fibres in admixture with other fibrous materials, which may be cellulosic or non-cellulosic. The amino-formaldehyde resin fibres should constitute at least 5% by weight of the total fibrous material in the shaped article.

Particularly useful sheet materials, e.g. paper and board, may be made from blends of amino-formaldehyde resin fibres and cellulose fibres containing 5 to 100%, preferably 10 to 50%, by weight of amino-formaldehyde resin fibres. Cellulose fibres that may be used include the lignin-free fibres such as cotton linters or chemical wood pulp e.g. paper making pulp made from the raw cellulose by treatment by chemical means such as the well known sulphate or sulphite processes, or lignin-containing fibres such as mechanical, semi-chemical, or thermomechanical wood pulp. Mixtures of lignin-containing and lignin-free cellulose fibres, e.g. mixtures of mechanical and chemical pulps, may be used.

The cellulose fibres may be lightly beaten or well beaten, depending on the intended use of the shaped article.

The invention is of particular merit in the production of sheet like products such as paper and board from fibrous materials comprising amino-formaldehyde resin fibres alone or in admixture with up to 90% by weight, based on the total weight of fibrous material, of cellulose fibres. Such products have improved mechanical properties compared to those in which there is no inter-fibre bonding and, in particular, have superior wet strengths. Thus inter-fibre bonded amino-aldehyde resin fibre containing papers have superior wet strengths to the 100% cellulose papers which have not been otherwise treated to promote wet strength, e.g. by the inclusion of a wet strength resin binder.

As mentioned hereinbefore, in contrast to the papers described in BP No. 1,574,344, the use of the amino-resin fibres in admixture with cellulose fibres gives a significant increase in bulk. An increase in bulk is generally desirable as it enables less raw materials to be used, with consequent economic advantages, to obtain a paper of given volume. While the bulk of an all-cellulose paper can be increased by reducing the degree of beating of the cellulose, this results in a reduction in paper strength. The incorporation of the amino-formaldehyde resin fibres enables an increase in bulk to be achieved without such a large decrease in paper strength.

As mentioned hereinbefore, the inter-fibre bonded papers of the present invention have improved wet strength compared to papers in which there is no inter-fibre bonding: this renders paper made in accordance with the invention particularly suited to applications such as filter papers. Increased bulk is desirable in such applications as the porosity increases with an increase in bulk.

Shaped articles made in accordance with the present invention from a mixture of amino-formaldehyde resin fibres and cellulose fibres, i.e. cellulose pulp have a bulk of at least $$A + 0.015 \times \frac{x}{100}\ \mathrm{cm}^3 \cdot \mathrm{g}^{-1}$$

where x is the percentage by weight of amino-formaldehyde resin fibre in the fibrous mixture, and A is the bulk of a shaped article made under similar conditions from the cellulose fibre alone. The increase in bulk given by the incorporation of the amino-formaldehyde resin fibres becomes greater as the degree of beating of the cellulose fibre increases: thus where the cellulose fibre is lightly beaten, so as to give a paper of high bulk, the increase in bulk may be little more than about $0.015\times(x/100)\mathrm{cm}^3\cdot\mathrm{g}^{-1}$ but with a more highly beaten cellulose pulp, particularly one giving a paper of bulk below about 2 $\mathrm{cm}^3\mathrm{g}^{-1}$ when made wholly from the cellulose fibre, the increase in bulk is generally at least $0.02\times(x/100)\mathrm{cm}^3\cdot\mathrm{g}^{-1}$.

Shaped articles made in accordance with the present invention from a mixture of cellulose fibres and mixing amino-formaldehyde resin fibres are preferably made from fibre mixtures containing 5 to 95, particularly 10 to 50, % by weight of amino-formaldehyde resin fibres and, correspondingly, 95 to 5, particularly 90 to 50% by weight of cellulose fibres.

Therefore further in accordance with the present invention there is provided a shaped article formed from a fibrous material comprising 5 to 95% by weight of amino-formaldehyde resin fibres having a degree of cure of at least 93% and, correspondingly, 95 to 5% by weight of cellulose fibre, said article exhibiting inter-fibre bonding wherein at least some of the amino-formaldehyde resin fibres are welded to each other and/or to the cellulose fibres at at least some of the points where the fibres touch one another, and said article having a bulk of at least $$A + 0.015 \times \frac{x}{100}\ \mathrm{cm}^3\mathrm{g}^{-1}$$

where x is the percentage by weight of the amino-formaldehyde resin fibres in said fibrous material and A is the bulk, in $\mathrm{cm}^3\cdot\mathrm{g}^{-1}$, of a similar shaped article made under the same conditions wholly from the cellulose fibres.

Shaped articles may also be made in accordance with the present invention from fibrous material containing only amino-formaldehyde resin fibres or amino-formaldehyde resin fibres in admixture with non-cellulosic fibres. These mixtures may, if desired, also contain cellulosic fibres. The non-cellulosic fibres may be synthetic organic fibres such as polyester, e.g. polyethylene terephthalate, fibres; polyolefin, e.g. polypropylene, fibres; or polyamide fibres; or inorganic fibres such as glass or asbestos fibres.

Where non-cellulosic fibres, or a mixture of cellulosic and non-cellulosic fibres are employed, the fibrous material contains at least 5% by weight of amino-formaldehyde resin fibres and, correspondingly, up to 95% by weight of the non-cellulosic fibres or mixture of cellulosic and non-cellulosic fibres. The amount of non-cellulosic fibres is preferably at least 10% by weight of the total weight of fibres in the shaped article. The fibrous material, other than the amino-formaldehyde resin fibres, preferably comprises 10 to 100% by weight of non-cellulosic fibres and, correspondingly, 90 to 0% by weight of cellulosic fibres.

Shaped articles, e.g. paper or other sheet like products, made in accordance with the present invention from amino-formaldehyde resin fibres alone or from mixtures containing non-cellulosic fibres, have a significant strength whether or not they also contain cellulose fibres. Thus they may have a burst index (bursting pressure measured according to the TAPPI standard procedure divided by the weight per unit area) of at least 0.2 kPa $\mathrm{m}^2\mathrm{g}^{-1}$.

Therefore in accordance with a further aspect of the invention there is provided a shaped article formed of fibrous constituents comprising 5 to 100% by weight of amino-formaldehyde resin fibres having a degree of cure of at least 93%, and correspondingly 0 to 95% by weight of a fibrous material consisting of 10 to 100% by weight of non-cellulosic fibres and correspondingly 0 to 90% by weight of cellulosic fibres, said article exhibiting inter-fibre bonding wherein at least some of the amino-formaldehyde resin fibres are welded to each other and/or to the non-cellulosic fibres at at least some of the points where the fibres touch one another, and said shaped article having a burst index of at least 0.2 kPa $m^2g^{-1}$.

Where the article contains cellulose fibres in addition to the non-cellulosic fibres, the amino-formaldehyde resin fibres may also be welded to the cellulosic fibres.

Particularly preferred fibre compositions comprise 10 to 90, especially 20 to 60, % by weight of amino-formaldehyde resin fibres, 10 to 90, especially 20 to 50, % by weight of non-cellulosic fibres, and 0 to 75, especially 10 to 50, % by weight of cellulosic fibres.

The invention is illustrated by the following examples in which all percentages are expressed by weight.

EXAMPLE 1

A commercially available aqueous urea/formaldehyde resin having a U:F molar ratio of 1:2 of solids content 67% was diluted with water to a viscosity of 30 poise. 10%, based on the solids, of an aqueous solution containing 1.6% poly(ethylene oxide) and 6.7% ammonium sulphate was mixed continuously with the resin solution as it was fed to a spinning cup of a centrifugal spinning apparatus. The resin was spun by the process described in U.S. Pat. No. 4,178,336 using a spinning cup of 12.7 cm diameter having 24 rectangular holes and rotating at 7000 rpm.

Air at 180° C. was blown into the spinning chamber to dry the fibres, to transport them from the spinning cup and to effect some curing. The resin was spun at a rate of 100 g $min^{-1}$. The fibres were continuously removed from the spinning apparatus and their cure was continued by heating in air at 150 C. for 40 minutes.

The resultant fibres, which had an average diameter of 8.5 μm, had a degree of curing of 94.6%.

The fibres were cut to a nominal length of 3 mm and dispersed in a standard laboratory pulp disintegrator in water (consistency 1.2%) for 17 minutes.

Paper handsheets (100% UF resin fibres) were made by the standard procedure using the British Standard Handsheet former with the replacement of the standard pressing step with pressing in a press heated to 110° C. Prior to pressing water was sprayed on to the handsheets was determined by weighing the handsheets before and after pressing.

After pressing the Burst Index, and Breaking Lengths of the papers were determined.

Burst Index (burst pressure in kPa divided by the substance in $gm^{-2}$) was determined according to the standard TAPPI procedure. The Breaking Lengths were measured on an Instron tensile tester (table top model) using samples 15 mm wide with a gauge length of 100 mm. The crosshead speed was 0.5 cm/min.

Inter-fibre bonding was assessed microscopically. Its presence is indicated in the following table by a tick.

| Pressure (kg $cm^{-2}$) | Time (min) | Moisture Content (%) | Inter-fibre bonding | Burst Index (kPa $m^2g^{-1}$) | Breaking Length (km) |
|---|---|---|---|---|---|
| 0.1 | 3 | 43 | x | 0.54 | 0.19 |
| 0.1 | 6 | 55 | x | 0.45 | — |
| 0.1 | 3 | 56 | x | 0.33 | — |
| 0.1 | 3 | 60 | √ | 0.35 | 0.51 |
| 0.1 | 3 | 81 | √ | 0.34 | 0.27 |
| 0.1 | 6 | 122 | √ | 0.34 | 0.67 |
| 0.1 | 3 | 137 | √ | 0.36 | 0.60 |

-continued

| Pressure (kg $cm^{-2}$) | Time (min) | Moisture Content (%) | Inter-fibre bonding | Burst Index (kPa $m^2g^{-1}$) | Breaking Length (km) |
|---|---|---|---|---|---|
| 0.1 | 3 | 222 | √ | 0.49 | 1.47 |
| 0.1 | 6 | 242 | √ | 0.36 | 0.59 |
| 0.1 | 3 | 294 | √ | 0.53 | 0.71 |
| 0.1 | 3 | 368 | √ | 0.69 | 1.89 |
| 5.5 | 4 | 16 | x | 0.25 | 0.13 |
| 5.5 | 4 | 22 | x | 0.32 | 0.25 |
| 5.5 | 4 | 40 | √ | 0.27 | 0.48 |
| 5.5 | 4 | 122 | √ | 0.51 | 1.59 |
| 5.5 | 4 | 165 | √ | 0.36 | 0.59 |
| 5.5 | 4 | 181 | √ | 0.42 | 0.74 |
| 5.5 | 4 | 212 | √ | 0.60 | 1.40 |
| 5.5 | 4 | 259 | √ | 0.36 | 1.02 |
| 5.5 | 4 | 732 | √ | 0.45 | 1.49 |
| 7.7 | 4 | 35 | √ | 0.39 | 0.75 |
| 11 | 4 | 31 | √ | 0.33 | 0.65 |
| 13.7 | 4 | 30 | √ | 0.28 | 0.74 |
| 16.4 | 4 | 25 | √ | 0.28 | 0.73 |

EXAMPLE 2

Example 1 was repeated using resin fibres cured for 120 minutes at 150° C. to give a degree of cure of 96.6%.

| Pressure (kg $cm^{-2}$) | Time (min) | Moisture content (%) | Inter-fibre bonding | Burst Index (kPa $m^2g^{-1}$) | Breaking Length (km) |
|---|---|---|---|---|---|
| 0.1 | 7 | 47 | x | 0.58 | — |
| 0.1 | 3 | 82 | x | 0.44 | 1.09 |
| 0.1 | 3 | 112 | √ | 0.58 | 1.53 |
| 0.1 | 3 | 214 | √ | 0.65 | 0.57 |
| 0.1 | 4 | 271 | √ | 0.86 | 1.79 |
| 0.1 | 3 | 322 | √ | 0.72 | 0.76 |
| 0.1 | 3 | 389 | √ | 0.93 | 1.40 |
| 5.5 | 4 | 85 | √ | 0.53 | 0.58 |
| 5.5 | 4 | 131 | √ | 0.54 | — |

EXAMPLE 3

Example 1 was repeated using resin fibres cured for 170 minutes at 150° C. to give a degree of cure of 97.9%.

| Pressure (kg $cm^{-2}$) | Time (min) | Moisture content (%) | Inter-fibre bonding | Burst Index (kPa $m^2g^{-1}$) | Breaking Length (km) |
|---|---|---|---|---|---|
| 0.1 | 5 | 65 | x | 0.36 | — |
| 0.1 | 7 | 116 | x | 0.32 | 0.27 |
| 0.1 | 9 | 137 | x | 0.36 | 0.57 |
| 0.1 | 3 | 180 | √ | 0.42 | 1.06 |
| 0.1 | 3 | 244 | √ | 0.75 | 1.21 |
| 0.1 | 3 | 418 | √ | 0.52 | 1.46 |
| 5.5 | 1 | 62 | x | 0.43 | 0.64 |
| 5.5 | 5 | 83 | √ | 0.73 | 1.16 |
| 5.5 | 3 | 89 | √ | 0.80 | 1.32 |
| 5.5 | 3 | 309 | √ | 0.43 | 0.61 |
| 5.5 | 3 | 465 | √ | 0.55 | 0.89 |

EXAMPLE 4

Example 1 was repeated using resin fibres cured at 150° C. for 330 minutes to give a degree of cure of 99.0%.

| Pressure (kg cm$^{-2}$) | Time (min) | Moisture content (%) | Inter-fibre bonding | Burst Index (kPa m$^2$g$^{-1}$) | Breaking Length (km) |
|---|---|---|---|---|---|
| 0.1 | 3 | 200 | x | — | — |
| 0.1 | 3 | 282 | x | — | — |
| 0.1 | 3 | 304 | √ | 0.32 | 0.81 |
| 0.1 | 6 | 429 | √ | 0.66 | 1.79 |
| 7.7 | 10 | 41 | x | 0.23 | — |
| 7.7 | 7 | 52 | √ | 0.59 | 1.31 |
| 7.7 | 5 | 78 | x | 0.40 | 0.97 |
| 7.7 | 7 | 229 | √ | 0.59 | 1.13 |
| 7.7 | 3 | 246 | √ | 0.38 | 0.63 |
| 7.7 | 5 | 455 | √ | 0.56 | 1.47 |
| 7.7 | 4 | 308 | √ | 0.38 | — |

EXAMPLE 5

Example 1 was repeated using resin fibres cured for 30 minutes at 150° C. to give a degree of cure of 96.4%. In each case the pressing time was 3 minutes at 110° C.

| Pressure (kg cm$^{-2}$) | Moisture Content (%) | Inter-fibre bonding |
|---|---|---|
| 21.9 | 35 | √ |
| 27.4 | 10.6 | x |
| 27.4 | 11 | √ |
| 32.9 | 9.8 | x |
| 32.9 | 11.8 | x |
| 32.9 | 22 | √ |

EXAMPLE 6

Example 1 was repeated using fibres cured for 30 minutes at 150° C. to give a degree of cure of 95.9%. In this example the moist sheets were pressed at a pressure of about 0.1 kg cm$^{-2}$ for varying times at various temperatures.

| Temp. °C. | Time (min) | Moisture content % | Inter-fibre bonding |
|---|---|---|---|
| 80 | 3 | 150 | x |
| 80 | 3 | 172 | x |
| 90 | ½ | 167 | x |
| 90 | 1 | 179 | x |
| 90 | 1 | 260 | x |
| 90 | 2 | 267 | √ |
| 110 | ½ | 302 | x |
| 110 | 1 | 174 | √ |
| 110 | 1 | 210 | √ |
| 127 | ½ | 224 | x |
| 127 | 3 | 114 | √ |
| 127 | 3 | 166 | √ |

The papers of Examples 1 to 6 that exhibited inter-fibre bonding maintained their integrity when immersed in water and gently agitated: those in which there was no inter-fibre bonding did not.

EXAMPLE 7

To demonstrate the improvement obtained in the wet strength of papers made from mixtures of urea-formaldehyde resin fibres and cellulose fibres by the present invention, paper handsheets were made from 80% birch sulphate pulp and 20% urea-formaldehyde resin fibres similar to those used in Example 1. Some of the handsheets were wetted and dried under inter-fibre bonding inducing conditions and the wet breaking length was measured.

The results are shown in the following table.

| Degree of cure (%) | Inter-fibre bonding | Wet breaking length (km) |
|---|---|---|
| 94.5 | no | 0.14 |
| 94.5 | yes | 0.19 |
| 96.8 | no | 0.15 |
| 96.8 | yes | 0.20 |

A similar handsheet made wholly from the birch sulphate pulp had a wet breaking length of 0.09 km.

EXAMPLE 8

Example 7 was repeated but using a 50/50 mixture of the birch sulphate pulp and the urea-formaldehyde resin fibres.

| Degree of cure (%) | Inter-fibre bonding | Wet breaking length (km) |
|---|---|---|
| 94.5 | no | 0.10 |
| 94.5 | yes | 0.25 |
| 96.8 | no | 0.04 |
| 96.8 | yes | 0.12 |

EXAMPLE 9

Papers were made on a pilot paper making machine from mixtures of lightly beaten bleached hardwood sulphate cellulose pulp and urea-formaldehyde resin fibres made by the procedure described in Example 1 and having a degree of cure of 94.6%. The paper was dried under light pressure against cylinders heated to about 100° C. The drying time and moisture content were sufficient to give inter-fibre bonding.

Paper was also made and dried under the same conditions from the lightly beaten cellulose pulp alone. The tensile strengths (wet and dry) in the transverse direction of the paper, i.e. at right angles to the machine direction, and the wet burst index was measured and are quoted in the table as a percentage of the corresponding properties of the all-cellulose paper.

| % UF fibre | Bulk cm$^3$g$^{-1}$ | Dry tensile | Wet tensile | Wet burst |
|---|---|---|---|---|
| 0 | 2.41 | 100 | 100 | 100 |
| 10 | 2.73 | 90 | 122 | 122 |
| 20 | 2.76 | 87 | 110 | 178 |
| 30 | 2.95 | 84 | 171 | 244 |

It is seen that the bulk increases by over 0.017 cm$^3$g$^{-1}$ for each percent of urea-formaldehyde fibres incorporated.

EXAMPLE 10

Example 1 was repeated using urea-formaldehyde resin fibres of average diameter 9 μm and 94.9% degree of cure, in admixture with glass or polyethylene terephthalate (PET) fibres, and also, in some cases with softwood sulphate cellulose pulp.

The glass fibres had a mean diameter of 20 μm while the PET fibres were 1.5 denier, drawn, uncrimped fibres that had been washed in warm water to remove any spin finish from their surfaces.

The glass, PET, and urea-formaldehyde fibres were cut to provide a length distribution between 1 and 5 mm by passing the fibres twice through a paper shredding machine with the cutters spaced at a nominal 3 mm.

To promote inter-fibre bonding the sheets were couched from the wire of the sheet former, placed on a non-stick plate, weighed, sprayed evenly with a little de-ionised water, reweighed and then pressed on each side for 30 seconds using a domestic ironing press at 170° C. giving an applied pressure of about 0.1 kg $cm^{-2}$. The weight of the dried paper was determined. The solids content of each sheet entering the press was thus determined, and so the moisture content as a percentage of the total fibre content was calculated.

Two sheets were prepared for each variation in the furnish and the Burst Index was measured at four locations on each sheet, and the average Burst Index was determined.

The result are shown in the following table.

| Furnish composition (%) | | | | Average Moisture content | Mean Burst Index |
|---|---|---|---|---|---|
| UF fibres | Glass | PET | Cellulose | % | (kPa $m^2g^{-1}$) |
| 50 | 50 | | | 452 | 0.39 |
| 75 | 25 | | | 363 | 0.37 |
| 90 | 10 | | | 571 | 0.27 |
| 50 | | 50 | | 405 | 0.28 |
| 75 | | 25 | | 438 | 0.34 |
| 90 | | 10 | | 421 | 0.25 |
| 20 | 50 | | 30 | 475 | 0.41 |
| 20 | 40 | | 40 | 388 | 0.83 |
| 20 | 30 | | 50 | 432 | 1.17 |
| 30 | 50 | | 20 | 549 | 0.31 |
| 33 | 33 | | 34 | 446 | 0.68 |
| 50 | 40 | | 10 | 585 | 0.26 |
| 50 | 30 | | 20 | 367 | 0.34 |
| 50 | 20 | | 30 | 381 | 0.64 |
| 20 | | 50 | 30 | 604 | 0.33 |
| 20 | | 40 | 40 | 567 | 0.69 |
| 20 | | 30 | 50 | 499 | 1.05 |
| 30 | | 50 | 20 | 459 | 0.28 |
| 30 | | 40 | 30 | 513 | 0.61 |
| 30 | | 30 | 40 | 502 | 0.71 |
| 33 | | 33 | 34 | 465 | 0.70 |
| 50 | | 40 | 10 | 510 | 0.26 |
| 50 | | 30 | 20 | 506 | 0.36 |
| 50 | | 20 | 30 | 478 | 0.73 |

All these papers exhibited inter-fibre bonding between the urea-formaldehyde resin fibres and the glass or PET fibres, and with the cellulose fibres where the latter were also present. All the papers retained their integrity when immersed in water.

EXAMPLE 11 (Comparative)

In Example 6 of UK Patent Specification No. 1,573,115 the production of paper from a mixture of urea-formaldehyde resin fibres and cellulose pulp on a Fourdrinier paper making machine is described. Examination of a sample of the paper produced in that Example revealed no inter-fibre bonding.

EXAMPLE 12

Urea-formaldehyde resin fibres made by the procedure described in Example 1 and having a degree of cure of 94% were mixed, in various proportions with a beaten cellulose pulp and made into handsheets by the British Standard method (which involves air drying at room temperature and does not promote inter-fibre bonding).

Similar sheets were also made but inter-fibre bonding induced by drying the sheets under light pressure against a cylinder heated to about 100° C.

In one series of experiments a ground wood, i.e. mechanical, cellulose pulp was used, which in another series a Kraft, i.e. chemical, pulp was employed. The burst indexes were measured.

| Fibre composition | | | Burst index (kPa $m^2g^{-1}$) | |
|---|---|---|---|---|
| UF fibres % | Ground wood % | Kraft % | Dried at room temperature | Dried at 100° C. |
| 10 | 90 | | 0.73 | 1.01 |
| 20 | 80 | | 0.62 | 0.90 |
| 50 | 50 | | 0.48 | 0.65 |
| 10 | | 90 | 3.81 | 5.03 |
| 20 | | 80 | 3.74 | 4.04 |
| 50 | | 50 | 1.66 | 1.84 |

It is seen that inter-fibre bonding gives a significant enhancement in the burst index.

We claim:

1. A process for making a shaped article comprising
   (i) forming a solution of an amino-formaldehyde resin free of bound inorganic oxyacid radicals and a curing agent therefor into fibres, said solution being free of carbohydrates,
   (ii) curing said fibres by heating them at above 100° C. until their degree of cure is at least 93%.
   (iii) forming an aqueous pulp by dispersing fibrous material in water, said fibrous material containing at least 5% by weight of said cured amino-formaldehyde resin fibres,
   (iv) forming a shaped article from said pulp, and
   (v) promoting inter-fibre bonding by heating said shaped article at a sufficiently high temperature above 80° C., for sufficient time, and in the presence of a sufficient amount of water above 10% by weight of the total weight of fibrous material present, with the application of pressure, before or during said heating, at least sufficient to cause contact between adjacent fibres, so as to cause at least some of the amino-formaldehyde resin fibres to weld to one another and/or to other fibrous material present at at least some of the points where the fibres touch one another.

2. A process according to claim 1 wherein said inter-fibre bonding is promoted by heating said shaped article at a temperature within the range 90° to 180° C.

3. A process according to claim 1 wherein the inter-fibre bonding is promoted by heating said shaped article in the presence of at least 200% by weight of water, based on the total weight of said fibrous material.

4. A process according to claim 1 wherein the shaped article is a sheet material and inter-fibre bonding is promoted by subjecting the article to the temperature above 80° C. during the drying of the water from the pulp.

5. A process according to claim 1 wherein the amino-formaldehyde resin fibres have a degree of cure between 94 and 99%.

6. A process according to claim 1 wherein the pulp contains a mixture of 10 to 50% by weight of amino-formaldehyde resin fibres and correspondingly 90 to 50% by weight of cellulose fibres.

7. A process according to claim 1 wherein the fibrous material of the pulp comprises only said amino-formaldehyde resin fibres.

* * * * *